United States Patent [19]

Nakai

[11] Patent Number: 4,553,867

[45] Date of Patent: Nov. 19, 1985

[54] DOT PRINTER CONTROL SYSTEM

[75] Inventor: Toshihiko Nakai, Saitama, Japan

[73] Assignee: Citizen Watch Co., Ltd., Tokyo, Japan

[21] Appl. No.: 560,193

[22] Filed: Dec. 12, 1983

[30] Foreign Application Priority Data

Dec. 20, 1982 [JP] Japan ..... 57-222164

[51] Int. Cl.[4] ..... B41J 19/30; B41J 19/50

[52] U.S. Cl. ..... 400/323; 400/54; 400/121; 400/322

[58] Field of Search ..... 400/54, 323, 50, 74, 400/669, 322, 121, 323.1; 323/201, 204; 361/52

[56] References Cited

FOREIGN PATENT DOCUMENTS 157781 9/1982 Japan ..... 400/54
160657 10/1982 Japan ..... 400/54
160678 10/1982 Japan ..... 400/669
134755 8/1983 Japan ..... 400/54

*Primary Examiner*—Paul T. Sewell
*Attorney, Agent, or Firm*—Koda and Androlia

[57] ABSTRACT

A dot printer comprising a power system for supplying power to a load; a setting circuit for setting a reference voltage value corresponding to a predetermined output current value within a range not in excess of a maximum rated output current of the power system; a detecting circuit for detecting an output value of the power system and for providing a voltage value corresponding to the output value; and a control circuit for comparing the voltage value provided by the detecting circuit with the reference voltage value of the setting circuit and controlling a printing operation to change the reciprocating printing by the print head from a bidirectional printing to a unidirectional printing when the voltage value provided by the detecting circuit is greater or smaller than the reference voltage value of the setting circuit.

3 Claims, 9 Drawing Figures

DOT PRINTER CONTROL SYSTEM

BACKGROUND OF THE INVENTION

1. Field of the Invention

This invention relates to a high speed dot printer for use as an output device for a data processing system such as a computer, a word processor and a drafting machine.

2. Description of the Prior Art

Impact serial dot printers have been known in which while a print head having a plurality of print wires equally spaced in a direction of a print sheet feed and having a plurality of electromagnetic solenoids for driving the print wires is reciprocated in a direction perpendicular to the print sheet feed, the plurality of print wires are selectively driven to impact the print sheet through an inked ribbon in accordance with printing information so as to cause the printing of characters, patterns and such. Also, in order to increase print speeds, impact dot line printers have been proposed in which while a print head having a plurality of print wires equally spaced in a direction perpendicular to a print sheet feed and having a plurality of electromagnetic solenoids for driving the print wires is continuously reciprocated in a direction also perpendicular to the print sheet feed, the plurality of print wires are selectively driven to impact the print sheet through an inked ribbon so as to cause the printing of characters, patterns and such.

These impact printers allow printing by impacting mechanically print wires or the like onto a print sheet. On the other hand, as serial dot printers or dot line printers like the aforementioned impact printers, there are also available, in various fields, non-impact printers such as thermal printers which allow printing non-mechanically on a special print sheet utilizing Joule's heat produced by application of a pulse current to a heating resistor, and ink jet printers which jet ink on a print sheet utilizing a momentary pressure wave generated by strain of a piezoelectric-crystal element.

In these serial dot printers and dot line printers, a bidirectional printing method has been used for effecting printing during both forward and return movement of the print head. However, in these printers, when printing characters or figure patterns requiring to drive successively printing elements such as electromagnetic solenoids and heating resistors on a thermal head, there is the possibility that a current supplied to the printing elements and their driver circuits will be increased and exceed the maximum rated current of the power system. In the past, therefore, in order to protect power systems when an output current exceeds the maximum rated value, they are designed to have a characteristic that the voltage abruptly drops (droop) or another characteristic that both voltage and current are reduced. However, if the output of the power system becomes low, printing pressure will run short, which may cause characters to appear unclear or not to be printed. In this case, it is necessary to interrupt printing.

SUMMARY OF THE INVENTION

The object of the invention is to prevent, in the aforementioned various dot printers, a current supplied to printing elements such as solenoids for driving print wires and heating resistors on a thermal head and their driver circuits from exceeding the maximum rated current of the power system and permit printing any printing pattern without interruption. The object of this invention is attained by providing a dot printer comprising: a power system for supplying power to a load; setting means for setting a reference voltage value corresponding to a predetermined output current value within a range not in excess of a maximum rated output current of said power system; detecting means for detecting an output value of said power system and for providing a voltage value corresponding to said output value; and control means for comparing the voltage value provided by said detecting means with the reference voltage value of said setting means and controlling a printing operation to change the reciprocating printing by said print head from a bidirectional printing to a unidirectional printing when the voltage value provided by said detecting means is greater or smaller than the reference voltage value of said setting means. Thus, without any interruption, the printing operation can be performed, keeping a uniform print quality.

DESCRIPTION OF THE PREFERRED EMBODIMENTS

Figure 1A:
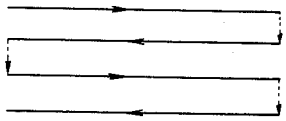
FIGS. 1A and 1B are views respectively illustrating a bidirectional printing operation and a unidirectional printing operation by a dot line printer.
Figure 1B:
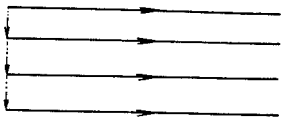
Figure 1C:
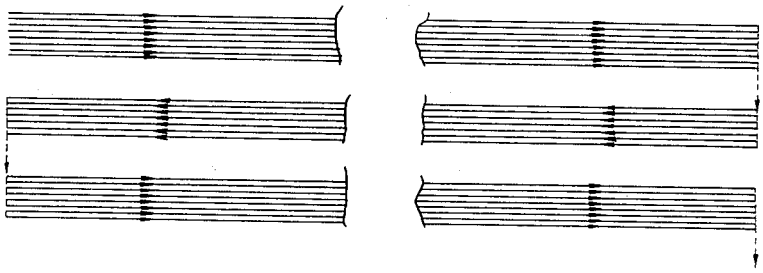
FIGS. 1C and 1D are views respectively illustrating a bidirectional printing operation and a unidirectional printing operation by a serial dot printer.
Figure 1D:
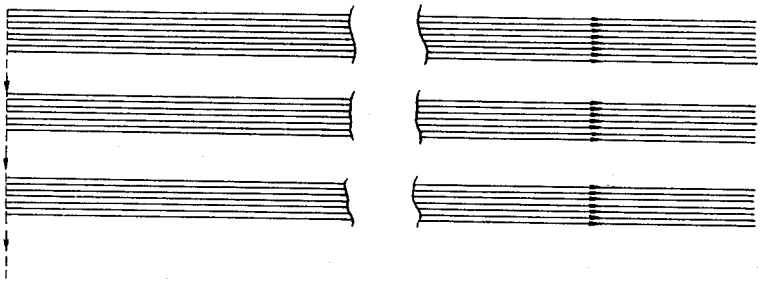

FIGS. 1A and 1B are enlarged views showing the relation of relative movement between print wires on a print head and a print sheet for a dot line printer, and FIGS. 1C and 1D are those for a serial dot printer, in which the solid lines represent the movement of the print wires during printing operation and the dashed lines represent the step feed of the print sheet.

Figure 2:
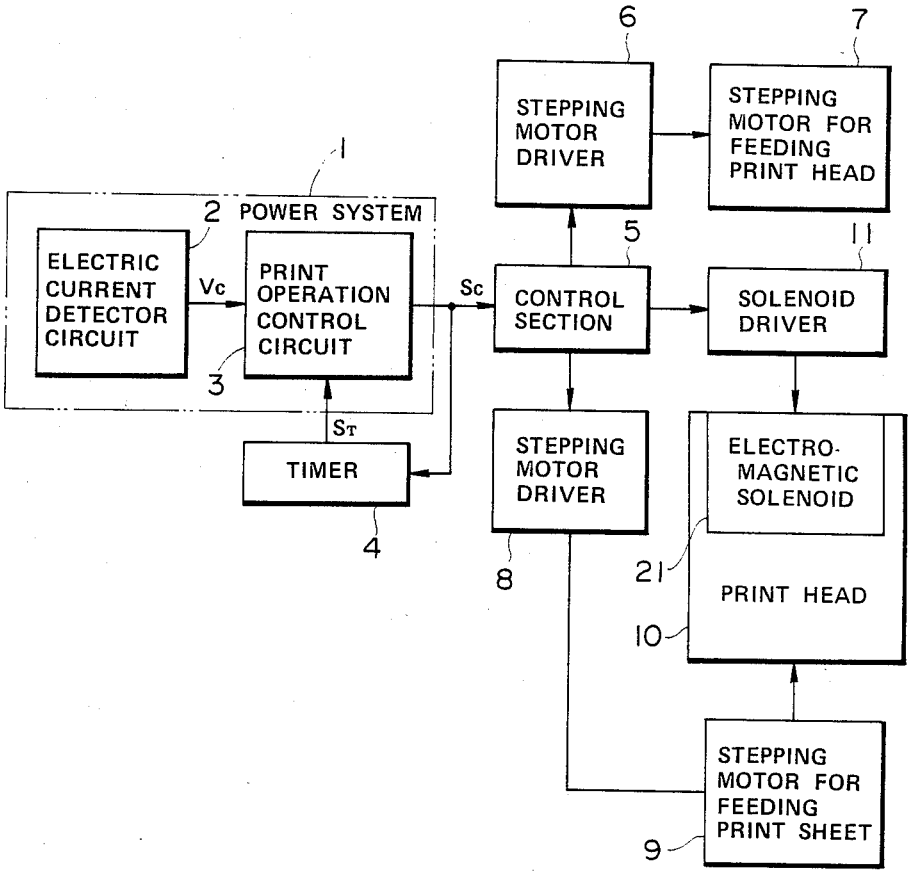
FIG. 2 is a block diagram illustrating one embodiment of carrying out the invention in a dot line printer or a serial dot printer.

Referring now to FIG. 2, within a power system 1 of a printer, an electric current detector circuit 2 is provided to detect an output current of the power system 1 and then to send a voltage signal $V_C$ corresponding to the detected ouput current. A print operation control circuit 3 comprises a voltage comparator for comparing the voltage signal $V_C$ of the current detector circuit 2 with a predetermined voltage. When the voltage signal $V_C$ is greater than the predetermined voltage, in particular within a range not in excess of a maximum rated current value of the power system 1, an output $S_C$ goes from a low level to a high level, and this high level output is applied to a control section 5 comprising a microcomputer and is simultaneously applied to a timer 4 to start it. The control section 5 receives character data or figure data from a data processor, not illustrated and sequentially stores them once in a random access memory unit, not illustrated. Then, while reading out the data, the control section 5 sends a signal to a stepping motor drive 6 which, in turn, sends the signal to a stepping motor for feeding print sheet 7. Also, the control section 5 sends a signal to a stepping motor driver 8 which, in turn, sends the signal to a stepping motor for feeding print head 10, the stepping motor 9 being used to control the direction of step travel of the print head 10. Furthermore, the control section 5 sends a signal to a solenoid driver 11 which, in turn, sends the signal to a plurality of electromagnetic solenoids 21 for driving selectively each of print wires. Since such print control by a microcomputer is well known to those skilled in the art, further details thereof are omitted.

As well as the control section 5, the solenoid driver 11 controlled thereby, each of solenoids 21 within the print head 10 and other aforementioned parts are powered by the power system 1.

Usually, as shown in FIGS. 1A and 1C, the bidirectional printing occurs during both forward (e.g. left to right as illustrated) and return (e.g. right to left as illustrated) movement of the print head 10. Each time the print head 10 moves forward or returns, the print sheet is fed by one pitch, and the sequence of readout of the dot data by the control section 5 is reversed between the forward and return movement. However, when a high level signal is given by the print operation control circuit 3, the control section 5 permits the readout of the dot data only during forward (or return) movement of the print head 10 and simultaneously makes the feed of the print sheet one pitch each reciprocation of the print head 10, thus changing the print control mode from the bidirectional print mode (printing occurs when the print head 10 is transported in either direction) to the unidirectional print mode (printing occurs when the print head 10 is transported only in one direction), as shown in FIGS. 1B and 1D. In this embodiment, during return movement of the print head 10, printing does not occur.

Accordingly, since the time required for energizing the solenoids 21 for driving each wire on the print head 10 and their driver 11 is reduced by about 50%, an average driving current during one reciprocation of the print head 10 can also be reduced by 50%. As a result, the load of the power system 1 is reduced, thereby lowering the output current.

A fixed time (e.g. one minute) after the timer 4 starts, it sends a signal $S_T$ to the print operation control circuit 3. At this time, if the current detector signal (voltage signal) $V_C$ of the current detector circuit 2 is smaller than the set value, the print operation control circuit 3 makes the output signal $S_C$ low. Thus, the control section 5 returns the print control mode to the usual mode, that is, the bidirectional print mode. On the other hand, if the current detector signal $V_C$ of the current detector circuit 2 remains greater than the set value when the timer 4 gives the signal $S_T$, the print operation control section 5 continues print control in unidirectional mode.

When printing a solid black pattern in which almost all the print wires on the print head 10 continue being driven, the increase in driving current makes the output current of the power system 1 large. As result, the current detector signal $V_C$ of the current detector circuit 2 is greater than the set value, and the output $S_C$ of the print operation control circuit 3 goes high. Then, the print control mode by the control section 5 changes from the bidirectional print mode to the unidirectional print mode, thereby reducing the average driving current and preventing the output current of the power system 1 from exceeding the maximum rated current.

In this embodiment, instead of the timer 4, a clock counter may be incorproated in the microcomputer of the control section 5 so that the output $S_C$ of the print operation control circuit 3 can be checked every fixed time. Otherwise, the print operation control circuit 3 may be provided with the hysteresis property. In this case, once the output $S_C$ goes high, the output is prevented from going low immediately even if the current detector signal $S_C$ is smaller than the set value.

Figure 3:
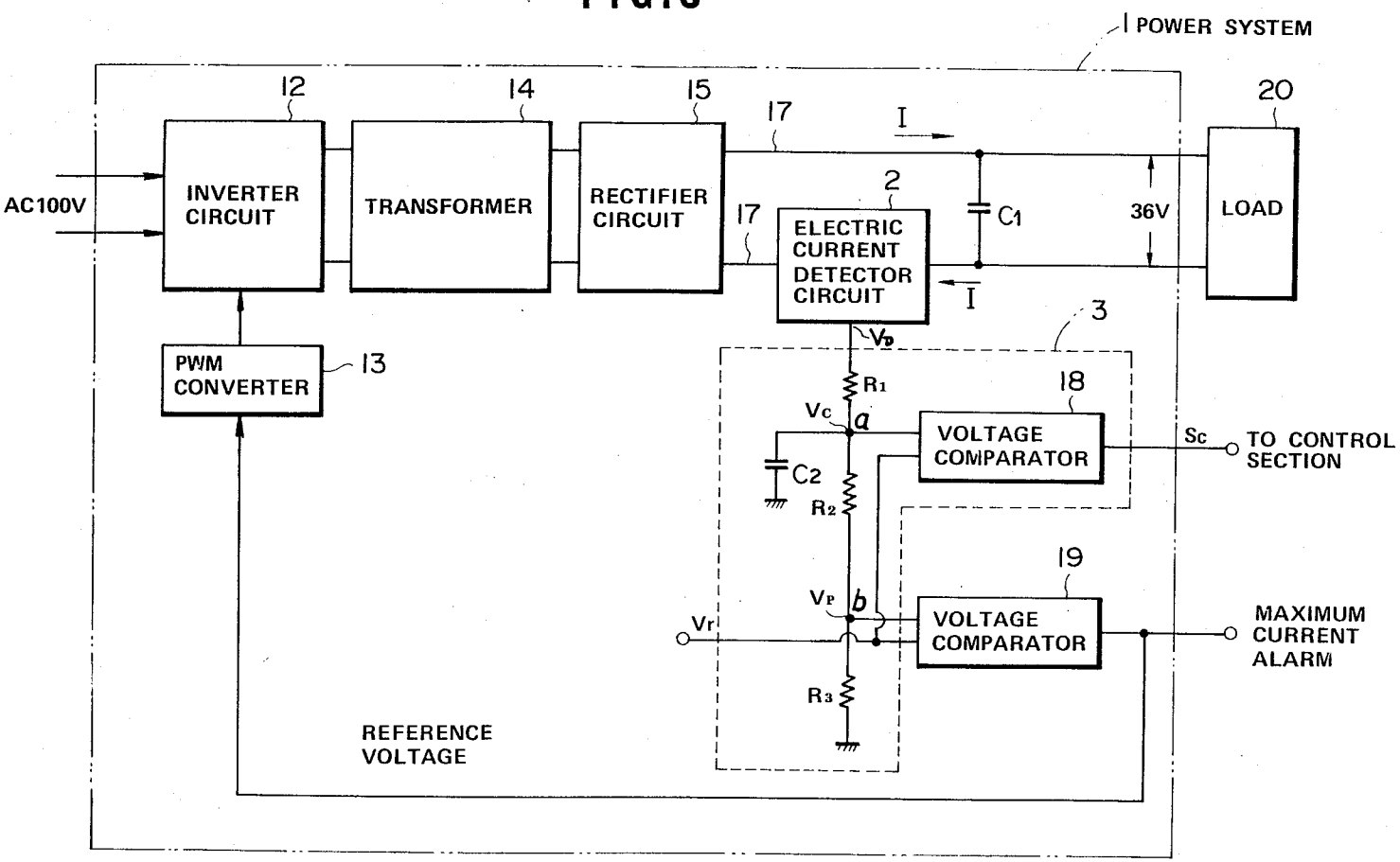
FIG. 3 is a partial detail view illustrating a modification of the embodiment of FIG. 2.

FIG. 3 is a partial detail view illustrating a modification in which the current detector circuit 2 and the print operation control circuit 3 of the embodiment of FIG. 2 are provided in the power system 1 thereof. This power system 1 uses a switching regulator. AC 100 V of a commercial power source is applied to an inverter circuit 12, and is once rectified and converted to direct current thereby. Next, the direct current is pulsed by a switching element controlled by a pulse width modulation (PWM) converter circuit 13. Furthermore, the pulse is fed to a transformer 14, and the resulting output obtained through the transformer 14 is rectified by means of a rectifier circuit 15 and smoothed by means of a high-value capacitor $C_1$. Thus, a load 20 of the print head 10 and such of the printer is supplied with a direct-current output, e.g. of 36 V.

Figure 4A:
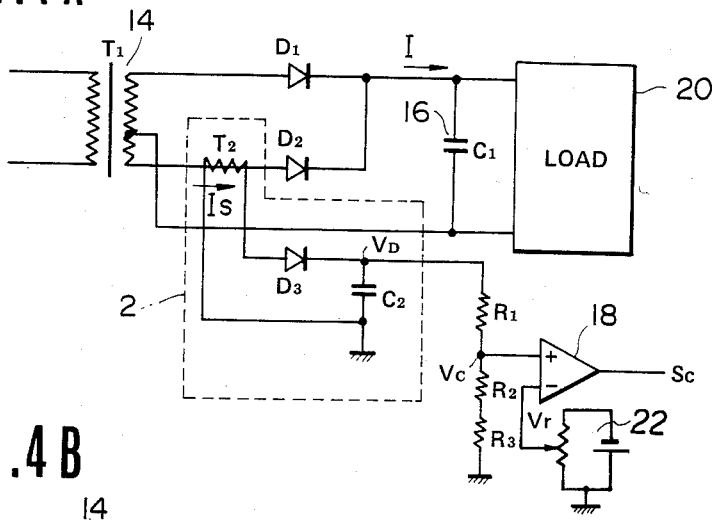
FIG. 4A is a view of one example of a current detector circuit used in the embodiments of FIGS. 2 and 3.
Figure 4B:
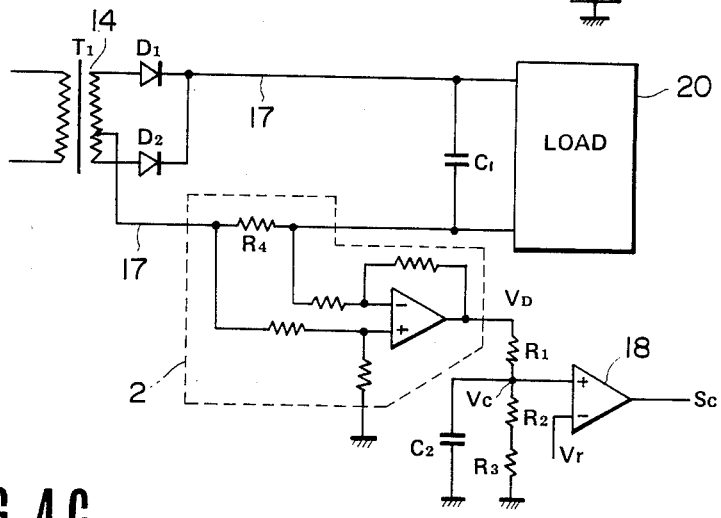
FIG. 4B is a view of another example of a current detector circuit used in the embodiments of FIGS. 2 and 3.
Figure 4C:
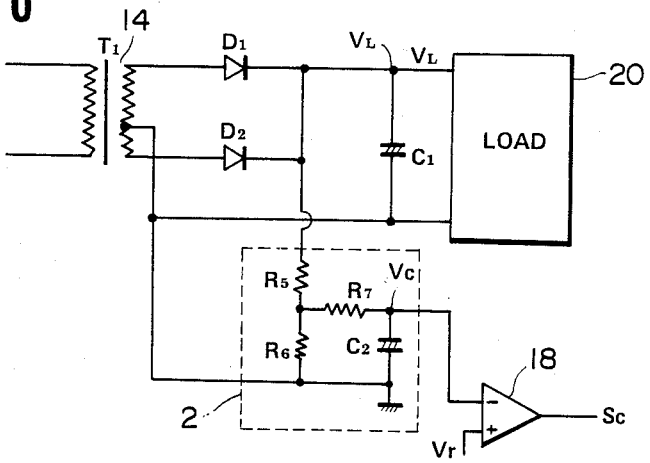

One of output lines 17 of the rectifier circuit 15 is provided with the electric current detector circuit 2 of FIG. 2 to detect current I flowing through the output lines 17 and to provide a voltage signal $V_D$ corresponding to its current value. A prior-art circuit may be used as this current detector circuit 2. For example, as shown in FIG. 4B, a circuit comprising a resistor $R_4$ having a small resistance value may be inserted in one of the output lines 17 for detecting a voltage occurring across the resistor $R_4$, and as shown in FIG. 4A, a circuit may be prepared comprising a current transformer $T_2$, a rectifier $D_3$ for rectifying and smoothing the output of the transformer $T_2$, and a capacitor $C_2$. In the circuit of FIG. 4A, the current transformer $T_2$ is preferably inserted between the transformer 14 and the rectifier circuit $D_1$, $D_2$. With this circuit, as a current $I_S$ which flows through the current transformer $T_2$ is proportional to the load current I, a voltage $V_D$ derived from the current transformer $T_2$ is proportional to the load current I. If a value $V_C$ obtained by dividing $V_D$ is greater than the reference voltage Vr, an output $S_C$ of a voltage comparator circuit 18 goes high, detecting the overload. In this figure, numeral 22 denotes a prior-art setting circuit for setting the reference voltage value corresponding to the predetermined output current value within a range not in excess of the maximum output current of the power system 1.

Since the current detector circuit is little affected by variations in supply voltage, and variations in load current can be detected in a stable way, it is suitable to be used as a detector for a general high speed printer.

Returning now to FIG. 3, the print operation control circuit 3 comprises resistors $R_1$, $R_2$, $R_3$, an integrating capacitor $C_2$, and a first voltage comparator 18. The voltage signal $V_D$ produced by the current detector circuit 2 corresponding to the value of current which flows through the output line 17 is divided by the resistors $R_1$ to $R_3$ to take out the voltage signal $V_C$ for detecting the intermediate current from a voltage dividing point (a) and to send it to the first voltage comparator 18. This first voltage comparator 18 compares the voltage signal $V_C$ with a reference voltage Vr, e.g. of 2.5 V, and makes the output high when $V_C \geqq Vr$. The output is then applied to the control section 5 in FIG. 2, thereby changing the print mode from the bidirectional to the unidirectional printing. For example, the voltage ratio divided by the resistors $R_1$ to $R_3$ and the reference voltage Vr are set so that with a maximum rated value of the power system of 10A, $V_C \geqq Vr$, when the output current I reaches 7.5 A.

Furthermore, in this embodiment, a voltage signal $V_P$ ($V_P < V_C$) for detecting the maximum current is taken out from the voltage dividing point (b) and applied to a second voltage comparator 19. This second voltage comparator 19 compares the voltage signal $V_P$ with the reference voltage Vr and makes the output high when $V_P \geqq Vr$ and then sends it to the PWM converter circuit 13. Thus, the pulse width produced by the inverter circuit 12 is narrowed so as to lower the output of 36 V, thereby protecting the power system 1. Also, the output of the voltage comparator 19 permits alarm display and stop of printing operation. For this detection, the voltage division ratio at point (b) and the reference voltage Vr are preset so that $V_D \geqq Vr$, for example, when the output current I is 10 A.

In this embodiment, the voltage signal $V_C$ for detecting the intermediate current and the voltage signal $V_P$ for detecting the maximum current are different and the reference value Vr is the same. Needless to say, however, both voltage signals $V_C$, $V_P$ may be the same, and the reference voltages Vr of the first and second voltage comparators 18, 19 may be different.

In general, with the power system for sending direct current by use of the rectifier circuit, a smoothing capacitor $C_1$ having a relatively high value is incorporated on the output side. However, in case of a power system for use in an apparatus with a great variation in load current such as a printer, a capacitor, in particular, having a high value is inserted so that the current amount increased by momentary load current can be supplied with the discharge current of the capacitor.

In the embodiment of FIG. 3, since the value of the capacitor $C_1$ is large, a momentary large load current in the unidirectional print mode can be supplied with the discharge current of the capacitor $C_1$, thereby lowering the average output current I than that in the bidirectional print mode. Moreover, the ripple effect of an output current of the rectifier circuit 15 and the increase in momentary current are accommodated by the capacitor $C_2$ so that they do not occur in the detected voltage $V_C$.

As described with reference to the embodiments, the dot printer of the invention does not cause poor print or interruption of print operation even if any print pattern is printed, and in the event that the load current for driving the print wires is excessive, the bidirectional print mode will be changed to the unidirectional mode so as to reduce the average load current. Therefore, though the printing speed becomes slow momentarily at the change, the printing can be continued without degrading print quality.

Also, the set value for switching the printing operation can be determined without due consideration for the variation in actual current value, and the printer can be utilized effectively until the allowed maximum of the power system.

From the above, it should be apparent that the within invention utilizes a preset intermediate reference level current value which is not in excess of the maximum rated current and before a voltage drop occurs corresponding to the maximum supply current, the printing rate is decreased and the print quality is maintained constant.

What is claimed is:

1. A dot printer in which while a print head is reciprocated in a direction substantially perpendicular to a print sheet feed, said print head is powered to cause selectively a printing of characters and patterns on said print sheet, said dot printer comprising:

a power system for supplying power to a load;

setting means for setting a reference voltage level value corresponding to a predetermined intermediate output current value within a range not in excess of maximum rated output current of said power system;

detecting means for detecting a current flowing through output lines of said power system and for providing a voltage value corresponding to said current, said reference voltage level value corresponding to a predetermined intermediate output current value being determined so that said current flowing through output lines of said power system does not usually get to the maximum rated output current even if the current increases; and control means for comparing the voltage value provided by said detecting means with the reference voltage value of said setting means and for controlling a printing operation to change the reciprocating printing by said print head for a bidirectional printing to a unidirectional printing when the voltage value provided by said detecting means is greater than the reference voltage of said setting means.

2. A dot printer in which while a print head having a plurality of print wires equally spaced in a direction of a print sheet feed is reciprocated in a direction substantially perpendicular to the print sheet feed, said print head is powered to cause selectively a printing of characters and patterns on said print sheet, said dot printer comprising:

a power system for supplying power to a load;

setting means for setting a reference voltage value corresponding to a predetermined intermediate output current value within a range not in excees of a maximum rated output current of said power system;

detecting means for detecting a current flowing through output lines of said power system and for providing a voltage value corresponding to said current, said reference voltage level value corresponding to a predetermined intermediate output current value being determined so that said current flowing through output lines of said power system does not usually get to the maximum rated output current even if the current increases; and control means for comparing the voltage value provided by said detecting means with reference voltage value of said setting means and for controlling a printing operation to change the reciprocating printing by said printing head from a bidirectional printing to a unidirectional printing when the voltage value provided by said detecting means is greater than the reference voltage of said setting means.

3. A dot printer in which while a print head having a plurality of print wires equally spaced in a direction perpendicular to a print sheet feed, said print head is powered to cause selectively a printing of characters and patterns on said print sheet, said dot printer comprising:

a power system for supplying power to a load;

setting means for setting a reference voltage level value corresponding to a predetermined intermediate output current value within a range not in excess of maximum rated output current of said power system;

detecting means for detecting a current flowing through output lines of said power system and for providing a voltage value corresponding to said current, said reference voltage level corresponding to a predetermined intermediate output current level being determined so that said current flowing through output lines of said power system does not usually get to the maximum rated output current even if the current increases; and control means for comparing the voltage value provided by said detecting means with the reference voltage value of said setting means and for controlling a printing operation to change the reciprocating printing by said print head from a bidirectional printing to a unidirectional printing when the voltage value provided by said detecting means is greater than the reference voltage value of said setting means.

* * * * *